US011760612B2

(12) United States Patent
Schneider et al.

(10) Patent No.: US 11,760,612 B2
(45) Date of Patent: Sep. 19, 2023

(54) TELESCOPING JIB SYSTEM OF A MOBILE CRANE HAVING A BASIC TELESCOPING JIB AND AN ADDITIONAL TELESCOPING JIB, AND CORRESPONDING METHOD

(71) Applicant: Tadano Demag GmbH, Zweibrücken (DE)

(72) Inventors: Simon Schneider, Martinshöhe (DE); Martin Bauer, Steinwenden (DE); Traugott Feß, Bechhofen (DE)

(73) Assignee: Tadano Demag GmbH, Zweibrücken (DE)

( * ) Notice: Subject to any disclaimer, the term of this patent is extended or adjusted under 35 U.S.C. 154(b) by 8 days.

(21) Appl. No.: 17/534,597

(22) Filed: Nov. 24, 2021

(65) Prior Publication Data

US 2022/0162046 A1 May 26, 2022

(30) Foreign Application Priority Data

Nov. 25, 2020 (DE) ..... 102020131218.0

(51) Int. Cl.
*B66C 23/00* (2006.01)
*B66C 23/70* (2006.01)

(52) U.S. Cl.
CPC ..... *B66C 23/705* (2013.01); *B66C 23/708* (2013.01)

(58) Field of Classification Search
CPC ..... B66C 23/04; B66C 23/26; B66C 23/305; B66C 23/42; B66C 23/66; B66C 23/68; B66C 23/702; B66C 23/708; B66C 23/705
See application file for complete search history.

(56) References Cited

U.S. PATENT DOCUMENTS 3,945,333 A * 3/1976 Fritsch ..... B66C 23/702 212/292
10,640,339 B2 5/2020 Martin et al.
10,640,340 B2 5/2020 Kuhn et al.
10,647,553 B2 5/2020 Martin et al.
(Continued)

FOREIGN PATENT DOCUMENTS

DE 10164600 A1 * 7/2003 ..... B66C 23/705
DE 202008016604 U1 3/2009
DE 202008016604 U1 * 4/2009 ..... B66C 23/701
(Continued)

OTHER PUBLICATIONS

Co-pending and commonly owned U.S. Appl. No. 17/523,063, filed Nov. 10, 2021.

*Primary Examiner* — Emmanuel M Marcelo
(74) *Attorney, Agent, or Firm* — Gardner, Linn, Burkhart & Ondersma

(57) ABSTRACT

A telescoping jib system of a mobile crane having a basic telescoping jib and an additional telescoping jib that can be retracted and extended via a telescoping cylinder with a securing and locking unit. In order to improve the telescoping jib system, it is proposed that a securing unit is arranged on a tip of the telescoping cylinder, the securing unit comprises exclusively at least one driving bolt, via which an additional telescoping jib separate from the basic telescoping jib can be retracted into the basic telescoping jib. The invention also relates to a method for lengthening a basic telescoping jib of a mobile crane by means of an additional telescoping jib to form a telescoping jib system.

19 Claims, 7 Drawing Sheets

(56) References Cited

U.S. PATENT DOCUMENTS

| | | | |
|---|---|---|---|
| 10,781,083 | B2 | 9/2020 | Kuhn et al. |
| 2021/0139296 | A1 | 5/2021 | Heintz |

FOREIGN PATENT DOCUMENTS

| | | | | | |
|---|---|---|---|---|---|
| DE | 102007052954 | B3 | | 7/2009 | |
| DE | 102008062648 | A1 | | 1/2010 | |
| DE | 202018100059 | U1 | * | 2/2018 | ..... B66C 13/20 |
| DE | 102013011173 | B4 | | 5/2019 | |
| DE | 102020129454 | A1 | * | 5/2022 | ..... B66C 23/42 |
| DE | 102021203701 | B3 | * | 9/2022 | ..... B66C 23/54 |
| JP | 2011046496 | A | * | 3/2011 | |
| WO | WO-2018134249 | A1 | * | 7/2018 | ..... B66C 23/706 |

* cited by examiner

TELESCOPING JIB SYSTEM OF A MOBILE CRANE HAVING A BASIC TELESCOPING JIB AND AN ADDITIONAL TELESCOPING JIB, AND CORRESPONDING METHOD

CROSS REFERENCE TO RELATED APPLICATION

The present application claims the priority benefits of German Application No. 10 2020 131 218.0, filed on Nov. 25, 2020.

BACKGROUND AND FIELD OF THE INVENTION

The invention relates to a telescoping jib system of a mobile crane having a basic telescoping jib and an additional telescoping jib which can be retracted and extended via a telescoping cylinder with a securing and locking unit. The invention also relates to a method for lengthening a basic telescoping jib of a mobile crane by means of an additional telescoping jib to form a telescoping jib system.

In general, the total weight of a mobile crane having a telescoping jib which is authorized for traveling on public roads is determined by the permissible axle load, which is, for example, 12 t in Germany, and the number of axles. It results therefrom that parts of the mobile crane, such as e.g. a counterweight, a telescoping jib and a main jib extension, are often transported separately from the mobile crane which can travel on roads, in order to remain within the permissible axle loads. The length of the telescoping jib which typically consists of bending-resistant sheet metal boxes also contributes to the total permissible weight of the mobile crane.

A telescoping jib of a mobile crane is already known from the German utility model DE 20 2008 016 604 U1. The telescoping jib consists of a basic box in which a plurality of inner boxes are guided such that they can be retracted and extended in a coaxial manner. A further inner box can be inserted into the receiving innermost inner box in order to lengthen the telescoping jib. The further inner box is typically provided with locking bolts on its rear end. In order to facilitate the lengthening of the telescoping jib, the receiving inner box is provided with opposing bolting brackets, open at the front, on its head and inner sides. The locking bolts of the further inner box are introduced into these bolting brackets in order to position the receiving inner box and the further inner box with respect to each other. Then, a complete securing and locking unit of the telescoping jib is retracted into the further inner box, coupled to the further inner box via driving bolts, the locking bolts of the further inner box are unlocked from the bolting brackets by means of the securing and locking unit and then the further inner box is retracted into the receiving inner box and coupled at that location at a desired locking position.

A further telescoping jib of a mobile crane is also described in German patent document DE 10 2007 052 954 B3, the extension length of which can be doubled by inserting an additional telescoping jib. Typically, this telescoping jib comprises a telescoping system, wherein a first inner and a second outer securing and locking unit, which are both complete, are arranged on the extendible and retractable parts of the telescoping system. The outer securing and locking unit supports a guide profile head which, in conjunction with the insertion of the additional telescoping jib, is spaced apart from the outer securing and locking unit via a guide frame which can be installed therebetween.

Furthermore, German patent document DE 10 2013 011 173 B4 discloses a further method for assembling a mobile crane with a telescoping jib which comprises a linking section in which a telescoping cylinder and at least one retractable and extendible telescoping section are mounted. A telescoping section assembly can be transported separately from the linking section and only assembled at the place of usage. For this assembly, the telescoping section assembly is brought to an assembly position by means of an auxiliary crane, the telescoping section assembly protruding slightly into the linking section in the assembly position. Then, an auxiliary assembly head arranged on the telescoping cylinder moves into the linking section where it is detached via driving bolts with the telescoping section assembly and the locking bolts on the telescoping section assembly. Then, the telescoping section assembly is slowly retracted by the auxiliary assembly head. The auxiliary assembly head thus represents a fully-fledged securing and locking unit.

Furthermore, there is known from German laid-open document DE 10 2008 062 648 A1 a further telescopic crane jib having a basic jib which has a collar at the upper end. The basic jib consists of an outer telescoping section and at least one inner telescopic telescoping section. Connecting points are arranged on the collar in order to bolt-on either a roller head or a telescoping guide of a telescoping extension.

SUMMARY OF THE INVENTION

The present invention provides an improved telescoping jib system of a mobile crane and a method for lengthening a basic telescoping jib of a mobile crane by means of an additional telescoping jib to form a telescoping jib system.

In accordance with an aspect of the present invention, in the case of a telescoping jib system of a mobile crane having a basic telescoping jib and an additional telescoping jib that can be retracted and extended via a telescoping cylinder with a securing and locking unit, an improvement is achieved by virtue of the fact that a securing unit is arranged on a tip of the telescoping cylinder, the securing unit comprises exclusively at least one driving bolt, via which an additional telescoping jib separate from the basic telescoping jib can be retracted into the basic telescoping jib. In this way, simple and secure rigging in terms of lengthening basic telescoping jibs with additional telescoping jibs is achieved. After rigging, the provided telescoping cylinder can be operated as a quite normal full-stroke telescoping cylinder for inserting and pushing out the inner boxes or additional inner boxes. The normal telescoping process is not impaired. The feature "exclusively at least one driving bolt" of the securing unit in accordance with the invention is to be understood in the sense that only at least one driving bolt is provided in order to connect the securing unit with the additional telescoping jib. The securing unit in accordance with the invention does not comprise a locking unit in order to lock and unlock locking bolts between adjacent telescoping boxes. The locking bolts can be used to connect the telescoping boxes together in a desired extension position. The securing unit in accordance with the invention is thus not a fully-fledged securing and locking unit but has exclusively only the function of the securing unit in relation to the at least one driving bolt. Bolting of the additional telescoping jib is effected manually. This is effected either via a spring bias allocated to the locking bolts or via a latching mechanism in the locking bolts, which can be actuated externally.

In a particular embodiment, provision is made that the basic telescoping jib and the additional telescoping jib can be retracted and extended after rigging via the securing unit via a common telescoping cylinder with a single securing and locking unit. This is achieved via the additional securing unit in accordance with the invention. Therefore, it is not required to arrange a second complete securing and locking unit on the telescoping cylinder. Such a second complete securing and locking unit is on the one hand very expensive and complex and on the other hand the telescoping cylinder is then designed so short that an inner box or the additional inner box is firstly partially pushed out by the first securing and locking unit and then completely pushed out by the second securing and locking unit. As a result, additional bolting holes are needed on the basic box, the inner boxes or the additional inner boxes. The telescoping time is also increased because each box has to be received twice.

From a constructional point of view, provision is made that the securing unit is releasably fastened to the tip of the telescoping cylinder or to the tip of a cylinder housing of the telescoping cylinder. It is hereby possible to attach the securing unit to the telescoping device only as required.

In a particular embodiment, provision is made that the securing unit can be extended forwards out of a head end of the basic telescoping jib to a transfer position by means of the telescoping cylinder. The securing unit can thus be retracted into the additional telescoping jib arranged in its transfer position.

From a constructional point of view, provision is also made that the at least one driving bolt of the securing unit can be coupled to a foot end of the additional telescoping jib for retracting the additional telescoping jib into the basic telescoping jib having a recess.

In accordance with a further aspect of the invention at least one sensor is arranged on the securing unit, via which the alignment of the at least one driving bolt with the recess can be detected.

Provision is further made that the basic telescoping jib consists of one basic box and a plurality of inner boxes and the additional telescoping jib consists of one or more additional inner boxes.

In accordance with a further aspect of the invention, a method for lengthening a basic telescoping jib of a mobile crane by means of an additional telescoping jib to form a telescoping jib system, wherein the basic telescoping jib and the additional telescoping jib are retracted and extended via a telescoping cylinder with a securing and locking unit, becomes simpler and more secure by virtue of the fact that the telescoping cylinder is extended, prior to aligning the additional telescoping jib with the basic telescoping jib, so far that its tip protrudes slightly forwards out of the head end of the basic telescoping jib, in particular of the third inner box, and the securing unit is then fastened to the tip, and the additional telescoping jib is thereby aligned with the basic telescoping jib such that a first additional inner box of the additional telescoping jib extends with its longitudinal direction coaxial to a longitudinal direction of the basic telescoping jib and the foot end of the first additional inner box adjoins a head end of the third inner box or the foot end of the first additional inner box is retracted into the head end of the third inner box, then a securing unit fastened to a tip of the telescoping cylinder is retracted into the first additional inner box so far until at least one sensor arranged on the securing unit confirms—with the securing unit comprising exclusively at least one driving bolt—that a coupling position of at least one driving bolt of the securing unit to a recess of the first additional inner box is reached, then the at least one driving bolt is retracted into the recess in order to couple the securing unit to the additional telescoping jib, then the additional telescoping jib is retracted into the basic telescoping jib by the securing unit, then the additional telescoping jib is bolted in the basic telescoping jib and then the at least one driving bolt is withdrawn from the recess. The securing unit can thus be fastened to the telescoping device only as required.

In conjunction with the present invention, the feature that in the transfer position the foot end of the first additional inner box adjoins a head end of the third inner box or the foot end of the first additional inner box is retracted or inserted into the head end of the third inner box is understood to mean that in the transfer position a distance of 300 mm to −500 mm is produced between the foot end of the first additional inner box and the head end of the third inner box, as seen in the longitudinal direction of the telescoping jib system. The negative sign shows that the additional inner box is retracted or inserted. With reference to the adjoining, a distance of 50 mm to −50 mm which is as small as possible is preferred in terms of a gap. The greater the distance, the more complex the aligning operation has to be. For the retracted or inserted state, a distance in the range of −150 mm to −300 mm is preferred. In this context, it proves to be advantageous that, prior to aligning the additional telescoping jib with the basic telescoping jib, an inner box of the basic telescoping jib is at least partially pushed out by the telescoping device by means of the telescoping cylinder and is locked. It is thus achieved that during rigging the additional telescoping jib can be retracted sufficiently far into the basic telescoping jib for bolting.

The invention will be explained in more detail hereinafter with the aid of an exemplified embodiment illustrated in the drawings.

DESCRIPTION OF THE PREFERRED EMBODIMENTS

Figure 1:
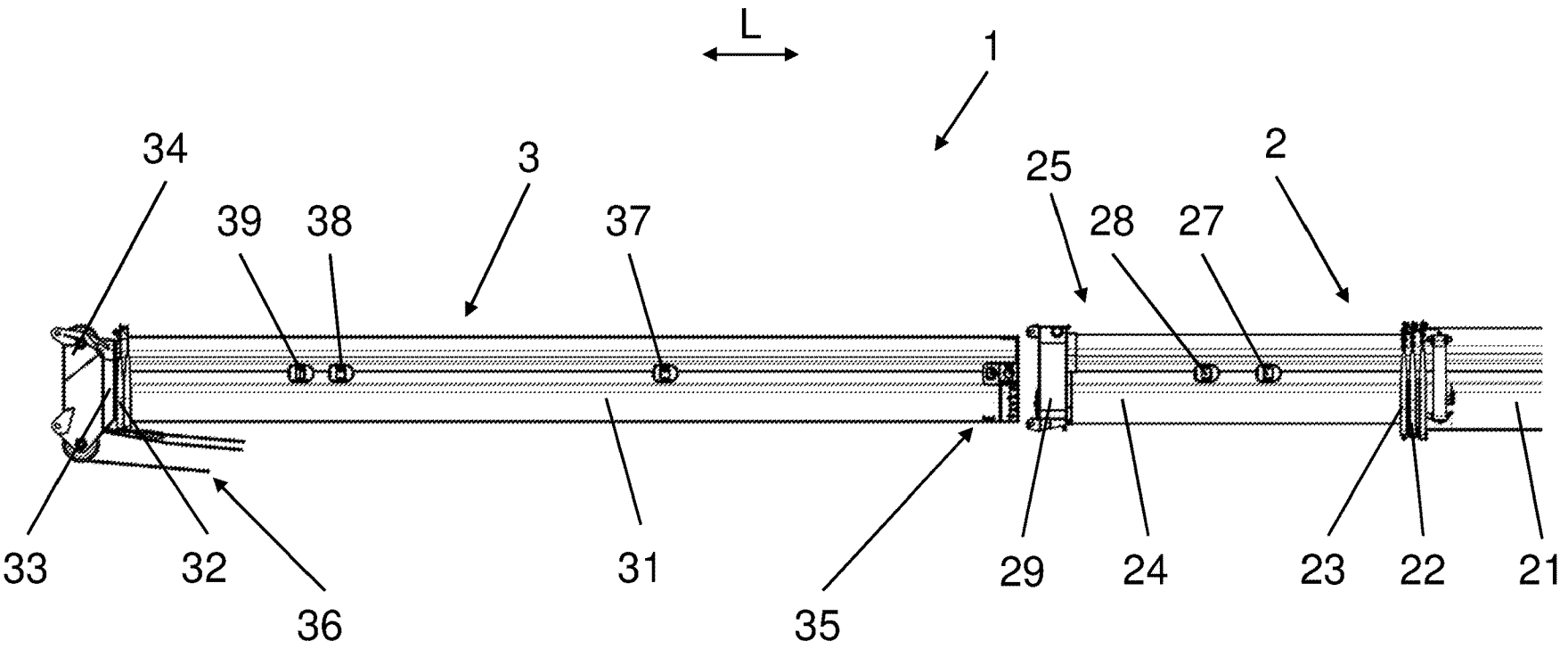
FIG. 1 shows a side view of a telescoping jib system in accordance with the invention in a transfer position.

FIG. 1 shows a side view of a telescoping jib system 1 in accordance with the invention in a transfer position. The telescoping jib system 1 consists of a basic telescoping jib 2 which can be lengthened as required by means of an additional telescoping jib 3 which can be inserted into the basic telescoping jib 2.

For reasons of space in FIG. 1, the basic telescoping jib 2 is shown only with its upper section. Typically, the basic telescoping jib 2 extends with its longitudinal direction L from its foot end, not shown, to its head end 25 and consists substantially of an outermost basic box 21 in which a first inner box 22, a second inner box 23 and a third inner box 24 are telescopically arranged one inside the other. The first inner box 22 and the second inner box 23 are each completely inserted into the basic box 21 and the third inner box 24 is located in its in this case preselected 45% extension position. Moreover, FIG. 1 shows, in a side wall of the basic box 21, a first bolting hole 26 which is to be allocated to a preselected 100% extension position of the first inner box 22 relative to the basic box 21. A second bolting hole 27 and—at a distance from the head end 25 and in the longitudinal direction L—a third bolting hole 28 can be seen on the third inner box 24. The second bolting hole 27 is to be allocated to a preselected 90% extension position of the third inner box 24 relative to the second inner box 23 and the third bolting hole 28 is to be allocated to a preselected 100% extension position of the third inner box 24 relative to the second inner box 23. Furthermore, a head adapter 29 is arranged on the head end 25 of the basic telescoping jib 2 or its third inner box 24, a roller head being able to be attached to the head adapter, for example, when the telescoping jib system 1 is operated only with the basic telescoping jib 2 and without the additional telescoping jib 3. The head adapter 29 externally engages around the head end 25 of the third inner box 24 and is fastened thereto. Moreover, the head end 25 of the third inner box 24 is free and open at the front in order to be able to receive the complete additional telescoping jib 3 in the basic telescoping jib 2. It is obvious that for this purpose the additional telescoping jib 3 and the basic telescoping jib 2 are adapted to one another accordingly.

In FIG. 1, the additional telescoping jib 3 is shown in full and is oriented in its transfer position connected to the basic telescoping jib 2 and in its extension. The additional telescoping jib 3 is brought to this transfer position by an auxiliary crane or a trailer or semi-trailer suitable for this purpose. The additional telescoping jib 3 extends with its longitudinal direction L from its foot end 35 to its head end 36 and consists substantially of an outermost first additional inner box 31 in which a second additional inner box 32 and a third additional inner box 33 are telescopically arranged one inside the other. The second additional inner box 32 and the third additional inner box 33 are each shown completely inserted and the first additional inner box 31 is located during its rigging process in a transfer position aligned with the head end 25 of the third inner box 24 and its longitudinal direction L and its foot end 35 adjoins the head end 25 of the third inner box 24 of the basic telescoping jib 2. FIG. 1 also shows, in a side wall of the first additional inner box 31, a fourth bolting hole 37 which is to be allocated to a preselected 45% extension position of the second additional inner box 32 relative to the first additional inner box 31 and—each at a distance from the head end 36 and in the longitudinal direction L—a fifth bolting hole 38 and a sixth bolting hole 39. The fifth bolting hole 38 is to be allocated to a preselected 90% extension position of the second additional inner box 32 relative to the first additional inner box 31 and the sixth bolting hole 39 is to be allocated to a preselected 100% extension position of the second additional inner box 32 relative to the first additional inner box 31. Furthermore, a roller head 34 is arranged on the head end 36 of the additional telescoping jib 3 or its third additional inner box 33.

The basic box 21, all the inner boxes 22, 23, 24 and all the additional inner boxes 31, 32, 33 are typically formed as box-like hollow profiles made of steel sheet having a rectangular cross-section with rounded corners and have at their respective foot ends locking bolts and recesses for driving bolts of a typical securing and locking unit 6 (see FIG. 7), with the bolts and recesses not being illustrated.

The telescoping jib system 1 is part of a mobile crane, not illustrated, which can travel on public roads and typically consists of a lower carriage with rubber-tired wheels and a superstructure which can be pivoted thereon about a vertical axis. The basic telescoping jib 2 or the telescoping jib system 1 is then articulated to the superstructure and opposite a counterweight so that it can be luffed about a horizontal axis. This articulation is effected via a foot connection, not illustrated in FIG. 1, on the basic box 21.

Typically, in order to change the length of the telescoping jib system 1, the inner boxes 22, 23, 24 and also the additional inner boxes 31, 32, 33 are linearly retracted and extended individually and successively from the basic box 21 or the next outer inner box 22, 23, 24 or additional inner box 31, 32 by means of a telescoping device, not illustrated for reasons of clarity. The telescoping device consists substantially of a hydraulic telescoping cylinder 4 (see FIG. 4) which is arranged centrally in the telescoping jib 1, in particular in the third inner box 24 or the third additional inner box 33, is supported in the region of the foot end of the basic box 21, extends in the longitudinal direction L and carries a so-called securing and locking unit 6 (see FIG. 7 on its extendible part, in particular on its lower end of the cylinder housing 42 (see FIG. 3). Via the securing and locking unit 6, on the one hand the telescoping cylinder 4 can be coupled via driving bolts for the retraction and extension of the respective inner box 22, 23, 24 or additional inner box 31, 32, 33 with recesses arranged at this location in the region of the respective foot ends and, on the other hand, the inner box 22, 23, 24 or additional inner box 31, 32, 33 which is to be retracted or extended in each case can be unlocked by moving locking bolts, not illustrated, of the respective inner box 22, 23, 24 or additional inner box 31, 32, 33 respectively from a locking position to an unlocking position in each case before the retraction or extension movement and can be locked after the retraction or extension movement by moving the respective locking bolt from its unlocking position to its locking position. Typically, the locking bolts are arranged in the region of the foot ends of the inner boxes 22, 23, 24 or additional inner boxes 31, 32, 33.

For reasons of clarity, the telescoping device, the telescoping cylinder, the securing and locking unit 6, the driving bolts and the recesses for the driving bolts are not shown in FIG. 1.

In FIG. 1, the first additional inner box 31 is illustrated or arranged with its foot end 35 in a first possible transfer position with respect to the head end 25 of the third inner box 24. A distance in the range of 0 mm to 300 mm, preferably 0 mm to 50 mm, which is as small as possible is provided between the foot end 35 and the head end 25. The greater the distance, the more complex the aligning operation has to be. The maximum extension length of the securing unit 5 out of the third inner box 24 must also be adapted accordingly. Therefore, distances of more than 300 mm would theoretically also be feasible.

Figure 2:
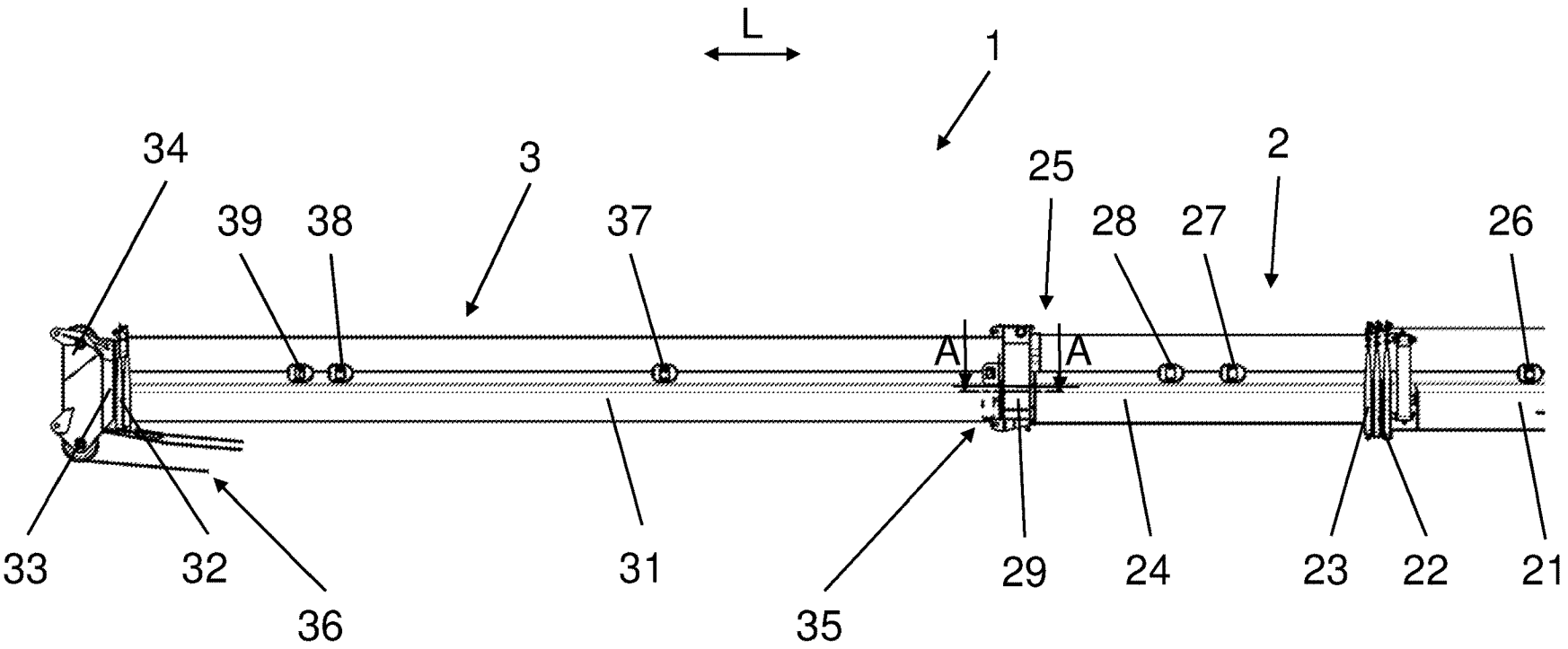
FIG. 2 shows a side view of a telescoping jib system in accordance with the invention in an alternative transfer position.

FIG. 2 shows a side view of a telescoping jib system 1 in accordance with the invention in an alternative and preferred transfer position, in which the first additional inner box 31 is retracted or inserted with its foot end 35 into the head end 25 of the third inner box 24. A distance in the range of greater than 0 mm to −500 mm, preferably −150 mm to −300 mm, is provided between the foot end 35 and the head end 25. The negative sign shows that the first additional inner box 31 is retracted or inserted into the third inner box 24.

Figure 3:
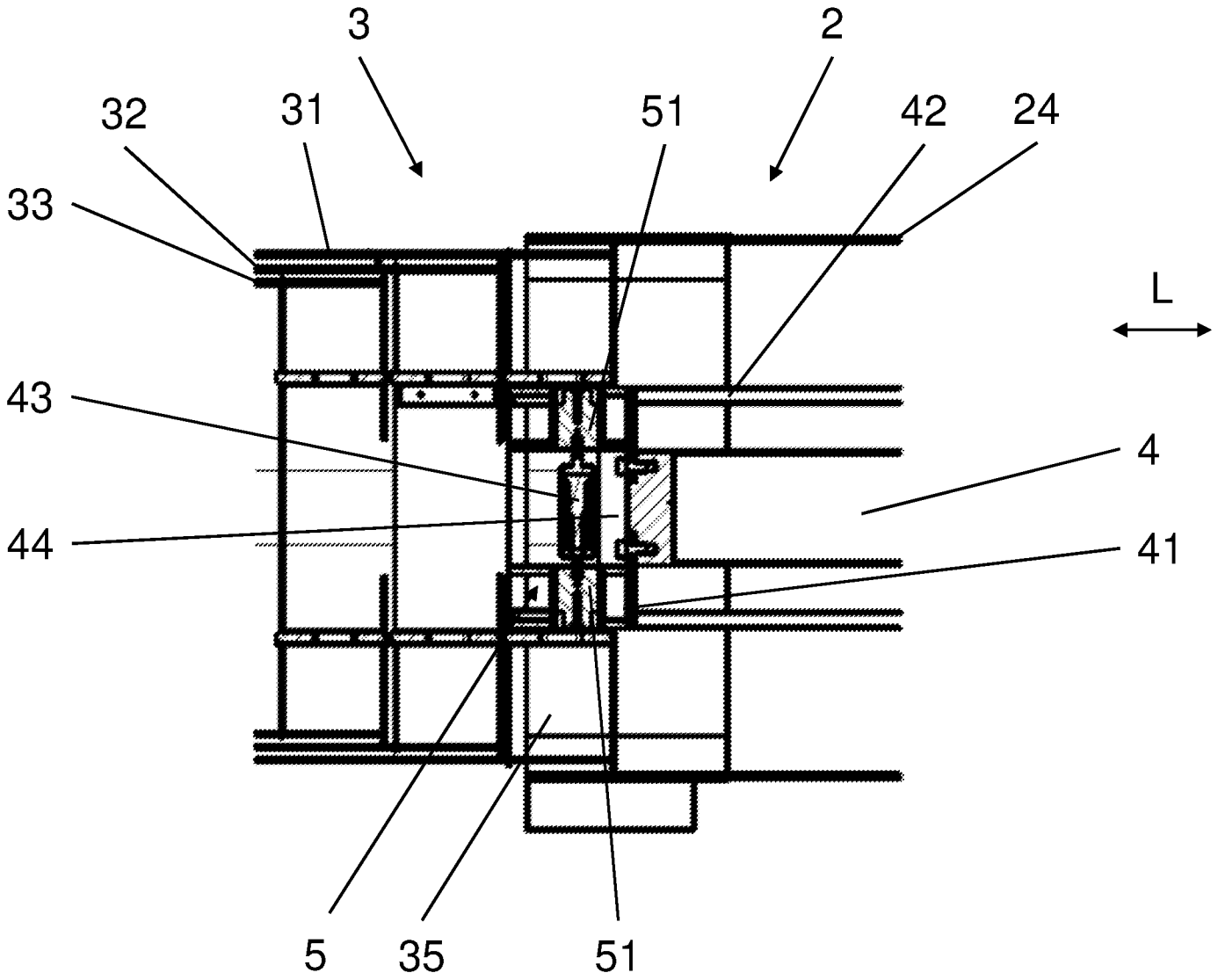
FIG. 3 shows an enlarged section of FIG. 2 along the section line A-A.

FIG. 3 shows an enlarged section of FIG. 2 along the section line A-A and thus from above the telescoping jib system 1. As previously described in relation to FIG. 2, the basic telescoping jib 2 and the additional telescoping jib 3 are arranged slightly retracted or inserted one inside the other in an alternative transfer position which is reached during a rigging process for lengthening the extension length of the basic telescoping jib 2 via an additional telescoping jib 3. In the present case, the distance between the foot end 35 and the head end 25, which describes how far the foot end 35 is retracted or inserted, is about −200 mm. In the transfer position, the additional telescoping jib 3 is aligned coaxially with and as an extension to the basic telescoping jib 2 and then a securing unit 5 is retracted out of the basic telescoping jib 2 into the foot end 35 of the first additional inner box 31. In the transfer position of FIG. 1, the securing unit 5 at least partially leaves the head end 25 of the third inner box 24.

By means of the securing unit 5, the first additional inner box 31 of the additional telescoping jib 3 can be received and retracted in the receiving third inner box 24 at a bolting point. The securing unit 5 is basically formed like a securing and locking unit known from the prior art, but is limited to the two driving bolts 51 which can be extended laterally and in opposite directions and does not have an actuation mechanism for the locking bolts on the inner boxes 22, 23, 24 and additional inner boxes 31, 32, 33. The driving bolts 51 are linearly displaceable via a common hydraulic cylinder from an unlocking position to a locking position against the force of a spring element. The movement direction of the driving bolts 51 thus extends transversely to the longitudinal direction L of the additional telescoping jib 3 and horizontally in the event that the additional telescoping jib 3 is oriented with its longitudinal direction L horizontally. In FIG. 3, the driving bolts 51 are shown in their locking position in which the respective front end of the driving bolt 51 is inserted into a recess 43, preferably an elongate hole-shaped bore, in the foot end 35 of the first additional inner box 31. These recesses 43 are typically provided in each inner box 22, 23, 24 and additional inner box 31, 32, 33 in order to cooperate with the driving bolts of the securing and locking unit 6 when telescoping the telescoping jib system 1 inwards and outwards. Corresponding recesses without reference signs are also provided in the second and third additional inner boxes 32, 33. It is also apparent from FIG. 3 that the securing unit 5 is flange-mounted via a coupling plate 44 on a tip 41 of the hydraulic telescoping cylinder 4, which tip is formed by a head end of a cylinder housing 42 of the telescoping cylinder 4.

Figure 4:
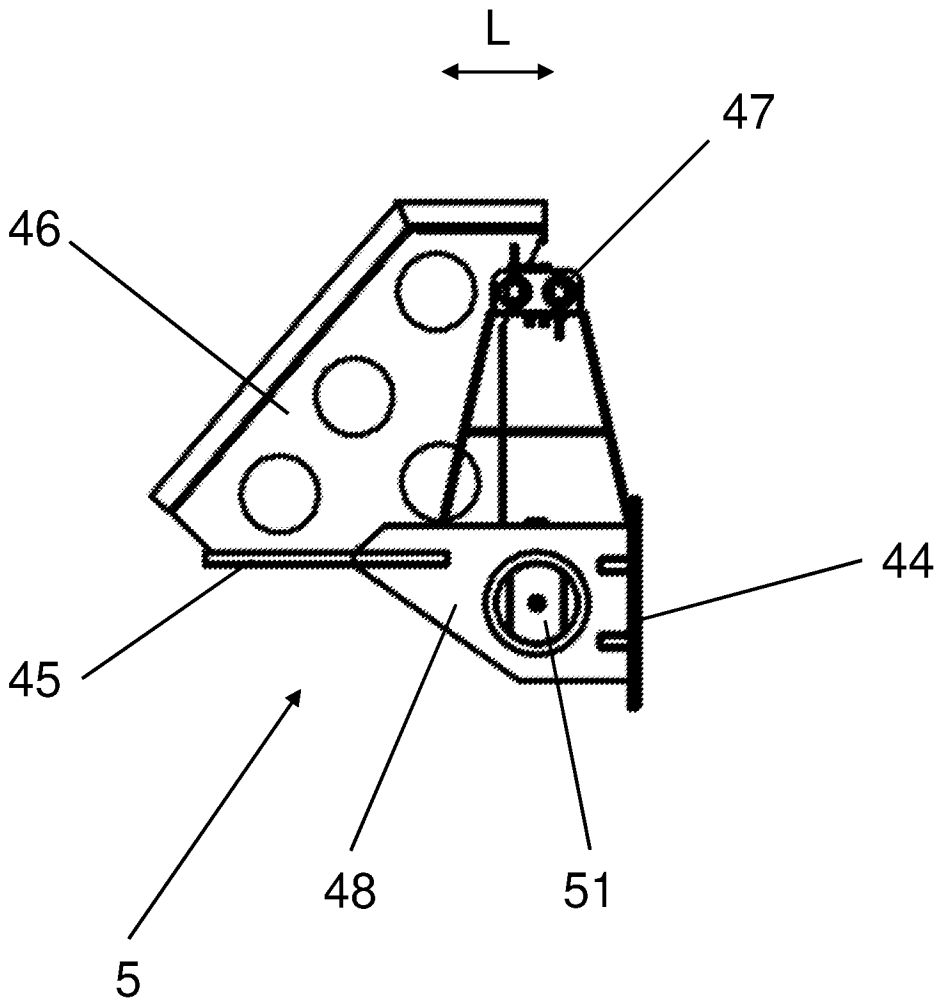
FIG. 4 shows a side view of a securing unit shown in FIG. 3.

FIG. 4 shows a side view of the securing unit 5 shown in FIG. 3. In addition to the driving bolts 51 described previously in conjunction with FIG. 3 and the coupling plate 44, it is also apparent that the securing unit 5 tapers, starting from the coupling plate 44, towards the additional telescoping jib 3 to be received, in order to facilitate retraction of the securing unit 5 into the additional telescoping jib 3. For this purpose, a guide plate 46 extending perpendicularly and in the longitudinal direction L is arranged on a base plate 45 extending horizontally from the coupling plate 44 in the longitudinal direction L, said guide plate having an upwardly facing edge which rises towards the coupling plate 44. In addition, arranged beneath the base plate 45 is a plate-like guide element 48 extending perpendicularly and in the longitudinal direction L and having a downwardly facing edge which rises towards the coupling plate 44. The base plate 45 is also enlarged towards the coupling plate 44. Furthermore, a sensor 47 is arranged above and on the base plate 45 via a perpendicular bracket, the sensor being able to be used to recognize the recess 43 in the first additional inner box 31 in order to be able to thus determine that the driving bolt 51 is aligned with the recess 43 in relation to the longitudinal direction L.

Figure 5:
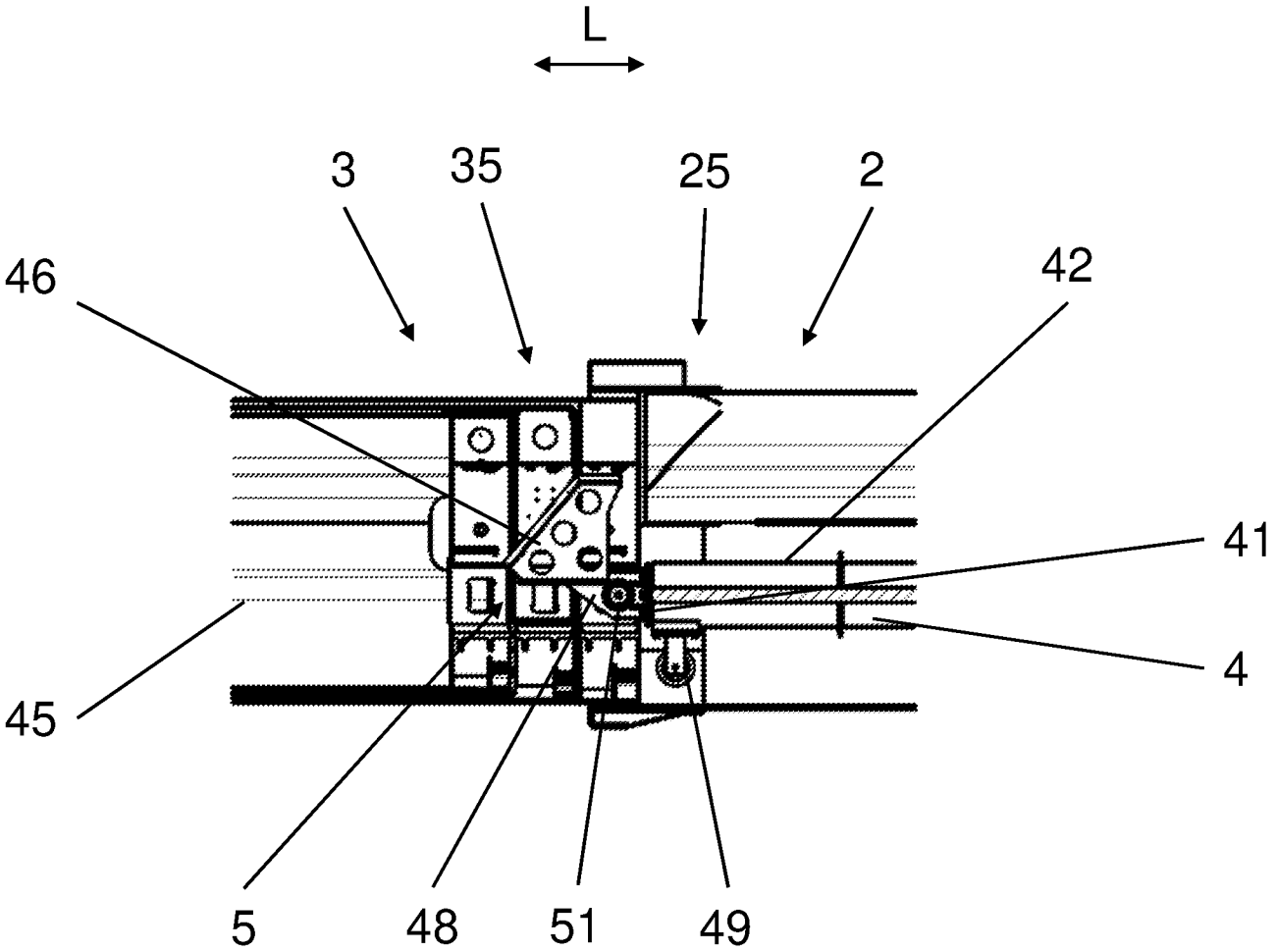
FIG. 5 shows a side view in the section of FIG. 3.

FIG. 5 shows a side view of FIG. 3 in section. The first additional inner box 31 is retracted or inserted with its foot end 35 into the head end 25 of the third inner box 24, as per the alternative and preferred transfer position. The securing unit 5 has also been retracted so far into the first additional inner box 31 until the driving bolts 51 are flush with the recesses 43 of the first additional inner box 31. FIG. 5 also shows that a support element 49 in the form of a roller is arranged on the tip 41 of the cylinder housing 42 of the telescoping cylinder 4. The support element 49 can also be a sliding element. By means of the downwardly extending support element 49, the telescoping cylinder 4 is supported or moved on the inside on the third inner box 24. In the coupling position of the driving bolts 51 shown in FIG. 5, the securing element 5 and the telescoping cylinder 4 are raised via the guide element 48 which functions like a ramp and is supported on an opening edge of the first additional inner box 31. This raising process is associated with aligning the securing unit 5 with the first additional inner box 31 and is effected when retracting the securing unit 5 into the first additional inner box 31.

Figure 6:
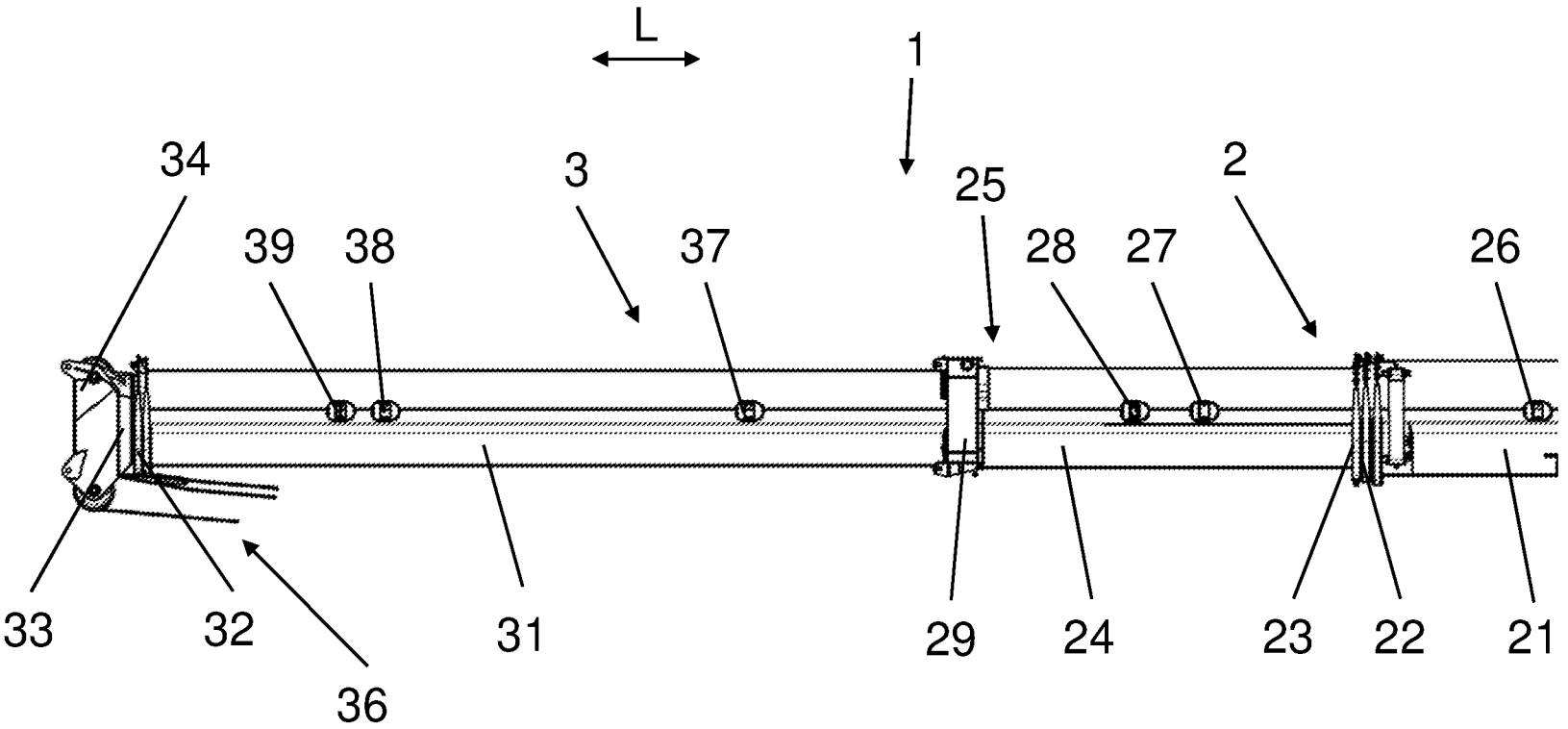
FIG. 6 shows a side view as per FIG. 1 or FIG. 2 with the telescoping jib system in an operating state.

FIG. 6 illustrates a side view according to FIG. 2 with the telescoping jib system 1 in an operating state. In this context, "operating state" is to be understood to mean that the basic telescoping jib 2 and the additional telescoping jib 3 are connected to form the telescoping jib system 1 such that they can be retracted and extended by a common telescoping device with a common securing and locking unit 6. The additional telescoping jib 3 has been retracted by the securing and locking unit 6 so far into the third inner box 24 that the first additional inner box 31 could be bolted with the typically provided locking bolts in the third bolting hole 28 of the first inner box 22.

For better understanding of the invention, a rigging process for inserting the additional telescoping jib 3 into the basic telescoping jib 2 to form the telescoping jib system 1 in accordance with the invention will be described hereinafter using FIGS. 1 to 6.

Typically, the additional telescoping jib 3 is transported separately to a place of usage of the mobile crane. The mobile crane can carry the basic telescoping jib 2 or this can also be transported separately therefrom. Depending upon the design of the basic telescoping jib 2, it may be necessary that in a first step of the rigging process the innermost inner box—in the present case a fourth inner box, not illustrated, having a fixedly mounted roller head—has to be removed from the basic telescoping jib 2. It may also be the case that a removed inner box having a roller head is replaced by an inner box open at the front without a roller head. In the present case of the previously described, third inner box 24 open at the front with a head adapter 29 lying on the outside, it may be necessary to detach a roller head connection element from the head adapter 29. In a second step, the third inner box 24 of the basic telescoping jib 2 is then raised to its 45% extension position by the telescoping device and is locked there. In this way, the telescoping cylinder 4 can then be retracted in the subsequent rigging process far enough into the third inner box 24 in order for the first additional inner box 31 to reach the third bolting hole 28 of the third inner box 24 and for the first additional inner box 31 to be locked there. In a third step, the driving bolts 51 of the securing and locking unit 6 are detached from the third inner box 24 and the telescoping cylinder 4 is extended so far that its tip 41 protrudes slightly forwards out of the head end 25 of the third inner box 24. In a fourth step, the additional securing unit 5 in accordance with the invention is now flange-mounted on the tip 41 of the cylinder housing 42 and is hydraulically connected, if it is not yet assembled. In a fifth step, the securing unit 5 is then retracted into the third inner box 24. Then, in a sixth step an auxiliary crane or a trailer or semi-trailer is used to align the additional telescoping jib 3 with the basic telescoping jib 2 such that the first additional inner box 31 extends with its longitudinal direction L coaxial to the longitudinal direction L of the basic telescoping jib 2, and then the first additional inner box 31 is inserted with its foot end 35 into the head end 25 of the third inner box 24. Then, in a seventh step the securing unit 5 is retracted so far into the first additional inner box 31 until the at least one sensor 47 confirms that the coupling position of the driving bolts 51 with the recesses 43 of the first additional inner box 31 is reached. As required, the first additional inner box 31 is aligned by the guide plate 46 in the vertical direction and by the base plate 45 transversely to the longitudinal direction L. Then, in an eighth step the driving bolts 51 are laterally extended and retracted into the recesses 43 in order to couple the securing unit 5 to the additional telescoping jib 3. In a ninth step, the locking bolts of the first additional inner box 31 are brought manually to their unlocking position. A tenth step is used to retract the additional telescoping jib 3 into the third inner box 24 to the third bolting hole 28 of the 100% extension position by means of the securing unit 5 or the telescoping cylinder 4. The first additional inner box 31 is guided with its lower sliding elements in the radii of a front bearing of the third inner box 24. At that location, in the third inner box 24 the additional telescoping jib 3 or the first additional inner box 31 is manually bolted to the third inner box 24. Bolting of the additional telescoping jib is effected manually. This is effected either via a spring bias allocated to the locking bolts or via a latching mechanism in the locking bolts, which can be actuated externally. In an eleventh step, the securing unit 5 is then detached from the first additional inner box 31 by withdrawing the driving bolts 51. The rigging process is thus completed. The additional telescoping jib 3 is disassembled from the basic telescoping jib 2 in the reverse sequence.

Figure 7:
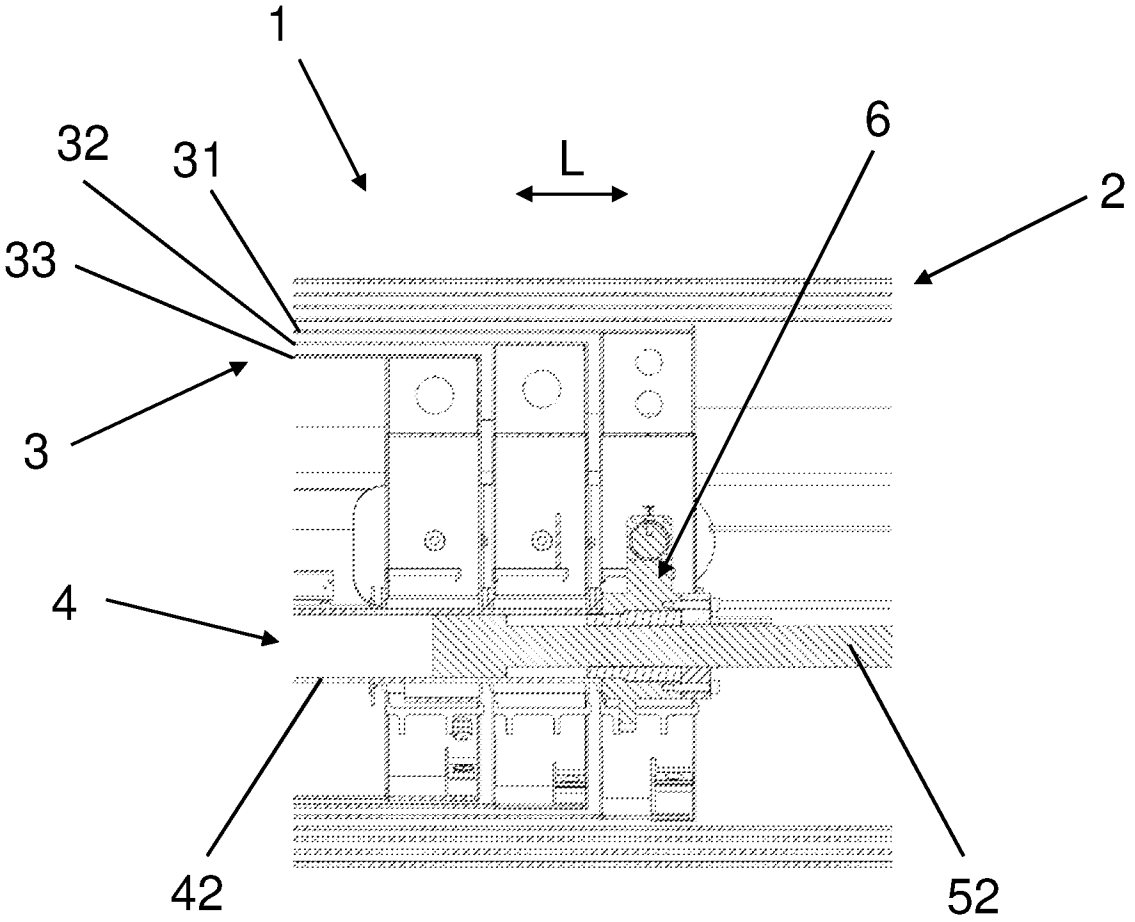
FIG. 7 shows a partial side sectional view of FIG. 6.

In FIG. 7 a partial side sectional view of FIG. 6 is shown. The telescoping jib system 1 together with its basic telescoping jib 2 and additional telescoping jib 3 is in the operating state. The securing and locking unit 6 comprises a casing or housing and is arranged at the inner end of the cylinder housing 42 of the telescoping cylinder 4 usually having a piston rod 52. The securing and locking unit 6 is engaged with the first additional inner box 31 via its driving bolts and ready to disengage the locking bolts of the first additional inner box 31 for moving the first additional inner box 31 within and relative to the basic telescoping jib 2. In connection with the securing and locking unit 6 the usual driving bolts and locking bolts are not shown.

The above exemplified embodiment is directed to a basic telescoping jib 2 having one basic box 21 and three inner boxes 22, 23, 24 and to an additional telescoping jib 3 having three additional inner boxes 31, 32, 33. Of course, different numbers of inner boxes 22, 23, 24 or additional inner boxes 31, 32, 33 can also be provided. An individual additional inner box 31 is also feasible.

Changes and modifications in the specifically described embodiments can be carried out without departing from the principles of the present invention which is intended to be limited only by the scope of the appended claims, as interpreted according to the principles of patent law including the doctrine of equivalents

The invention claimed is:

1. A telescoping jib system of a mobile crane comprising:

a basic telescoping jib and an additional telescoping jib that can be retracted and extended via a telescoping cylinder with a securing and locking unit;

wherein a securing unit is arranged on a tip of the telescoping cylinder, and wherein the securing unit comprises exclusively at least one driving bolt, via which the additional telescoping jib separated from the basic telescoping jib can be retracted into the basic telescoping jib.

2. The telescoping jib system as claimed in claim 1, wherein the telescoping cylinder comprises a common telescoping cylinder and the securing and locking unit comprises a single securing and locking unit, and wherein the basic telescoping jib and the additional telescoping jib are configured to be retracted and extended via the common telescoping cylinder with the single securing and locking unit.

3. The telescoping jib system as claimed in claim 2, wherein the securing unit is releasably fastened to the tip of the telescoping cylinder.

4. The telescoping jib system as claimed in claim 3, wherein the securing unit is releasably fastened to the tip of a cylinder housing of the telescoping cylinder.

5. The telescoping jib system as claimed in claim 4, wherein the securing unit can be extended forwards out of a head end of the basic telescoping jib into a transfer position by the telescoping cylinder.

6. The telescoping jib system as claimed in claim 5, wherein the at least one driving bolt of the securing unit is configured to be coupled to a foot end of the additional telescoping jib for retracting the additional telescoping jib into the basic telescoping jib having a recess.

7. The telescoping jib system as claimed in claim 6, wherein at least one sensor is arranged on the securing unit, via which the alignment of the at least one driving bolt with the recess can be detected.

8. The telescoping jib system as claimed in claim 7, wherein the basic telescoping jib consists of one basic box and a plurality of inner boxes and the additional telescoping jib consists of one or more additional inner boxes.

9. The telescoping jib system as claimed in claim 1, wherein the securing unit is releasably fastened to the tip of the telescoping cylinder.

10. The telescoping jib system as claimed in claim 9, wherein the securing unit is releasably fastened to the tip of a cylinder housing of the telescoping cylinder.

11. The telescoping jib system as claimed in claim 1, wherein the securing unit can be extended forwards out of a head end of the basic telescoping jib into a transfer position by the telescoping cylinder.

12. The telescoping jib system as claimed in claim 1, wherein the at least one driving bolt of the securing unit is configured to be coupled to a foot end of the additional telescoping jib for retracting the additional telescoping jib into the basic telescoping jib having a recess.

13. The telescoping jib system as claimed in claim 12, wherein at least one sensor is arranged on the securing unit, via which the alignment of the at least one driving bolt with the recess can be detected.

14. The telescoping jib system as claimed in claim 1, wherein the basic telescoping jib consists of one basic box and a plurality of inner boxes and the additional telescoping jib consists of one or more additional inner boxes.

15. A method for lengthening a basic telescoping jib of a mobile crane by means of an additional telescoping jib to form a telescoping jib system, wherein the basic telescoping jib and the additional telescoping jib are retracted and extended via a telescoping cylinder with a securing and locking unit, said method comprising:

extending the telescoping cylinder, prior to aligning the additional telescoping jib with the basic telescoping jib, so far that a tip of the telescoping cylinder protrudes slightly forwards out of a head end of the basic telescoping jib, wherein the basic telescoping jib comprises a plurality of inner boxes;

fastening the securing unit to the tip with the additional telescoping jib being thereby aligned with the basic telescoping jib such that a first additional inner box of the additional telescoping jib extends with its longitudinal direction coaxial to a longitudinal direction of the basic telescoping jib and a foot end of the first additional inner box adjoins a head end of a distal end inner box of the basic telescoping jib or the foot end of the first additional inner box is retracted into the head end of the distal end inner box;

retracting the securing unit fastened to the tip of the telescoping cylinder into the first additional inner box, wherein the securing unit comprises exclusively at least one driving bolt, and wherein the securing unit is retracted so far until a coupling position of the at least one driving bolt to a recess of the first additional inner box is reached;

confirming with at least one sensor arranged on the securing unit that the coupling position of the at least one driving bolt of the securing unit is reached;

retracting the at least one driving bolt into the recess in order to couple the securing unit to the additional telescoping jib;

retracting the additional telescoping jib into the basic telescoping jib by the securing unit;

bolting the additional telescoping jib in the basic telescoping jib; and withdrawing the at least one driving bolt from the recess.

16. The method as claimed in claim 15, wherein the method further comprises, prior to aligning the additional telescoping jib with the basic telescoping jib, at least partially pushing an inner box of the basic telescoping jib out by the telescoping cylinder and locking the inner box.

17. The method of claim 15, wherein the telescoping cylinder comprises a common telescoping cylinder and the securing and locking unit comprises a single securing and locking unit, and wherein the basic telescoping jib and the additional telescoping jib are configured to be retracted and extended via the common telescoping cylinder with the single securing and locking unit.

18. The method of claim 15, wherein the securing unit is releasably fastened to the tip of the telescoping cylinder.

19. The method of claim 18, wherein the securing unit is releasably fastened to the tip of a cylinder housing of the telescoping cylinder.

* * * * *